US006328820B1

(12) United States Patent
Yamamoto et al.

(10) Patent No.: US 6,328,820 B1
(45) Date of Patent: Dec. 11, 2001

(54) SPRING STEEL SUPERIOR IN FATIGUE PROPERTIES

(75) Inventors: Yoshinori Yamamoto; Masaki Nitta; Daisuke Ogura; Yoshio Fukuzaki, all of Kobe; Takeshi Kuroda, Osaka, all of (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/461,016

(22) Filed: Dec. 15, 1999

(30) Foreign Application Priority Data

Dec. 15, 1998 (JP) ..... 10-356652

(51) Int. Cl.[7] ..... C22C 38/02; C22C 38/04

(52) U.S. Cl. ..... 148/320; 148/540; 148/908; 148/333; 420/105

(58) Field of Search ..... 148/908, 334, 148/335, 320, 540, 333; 420/105

(56) References Cited

U.S. PATENT DOCUMENTS 5,415,711 * 5/1995 Takagi et al. ..... 148/546
5,651,937 * 7/1997 Descaves ..... 420/41
6,123,784 * 9/2000 Havette ..... 148/325

FOREIGN PATENT DOCUMENTS 1 010 769 6/2000 (EP) .
62-099437 5/1987 (JP) .
02-034748 2/1990 (JP) .
04-006211 1/1992 (JP) .
06-145895 5/1994 (JP) .
06-158226 * 6/1994 (JP) .

OTHER PUBLICATIONS

Patent Abstracts of Japan, vol. 1998, No. 09, Jul. 13, 1998, JP 10–102131, Apr. 21, 1998.

Chemical Abstracts, vol. 112, No. 2, Jan. 8, 1990, AN 10285, T. Ohshiro, et al., "Improvement of the Service Life of Valve Spring Wire", 1989.

* cited by examiner

*Primary Examiner*—Roy King
*Assistant Examiner*—Harry D. Wilkins, III
(74) *Attorney, Agent, or Firm*—Oblon, Spivak, McClelland, Maier & Neustadt, P.C.

(57) ABSTRACT

A spring steel containing $SiO_2$, $Al_2O_3$, CaO, and MgO as oxide type inclusions, which have an average composition (by weight) of $35\% \leqq SiO_2 \leqq 75\%$, $5\% \leqq Al_2O_3 \leqq 30\%$, $10\% \leqq CaO \leqq 50\%$, and $MgO \leqq 5\%$ (excluding 0%). This spring steel is superior in fatigue properties.

9 Claims, 3 Drawing Sheets

SPRING STEEL SUPERIOR IN FATIGUE PROPERTIES

BACKGROUND OF THE INVENTION

1. Field of the Invention

The present invention relates to a spring steel superior in fatigue properties. More particularly, the present invention relates to a spring steel (for valve springs and the like) superior in fatigue properties which is characterized by a low content of undeformable inclusions.

2. Description of the Related Art

It is a well-known fact that such steels as used for valve springs, which need a high fatigue strength, are liable to fracture that starts from hard non-metallic inclusions if they contain them. In order to prevent fracture due to such hard inclusions, there have been proposed several ways to control their composition such that they have a melting point lower than 1500° C. Such hard inclusions are made smaller by hot or cold rolling or drawing.

There is disclosed a steel with a high degree of cleanliness in Japanese Patent Publication No. 74484/1994. This steel contains non-metallic inclusions whose average composition is $SiO_2$: 20~60%, MnO: 10~80%, and CaO: 13~50%, and/or MgO: 5~15%. These non-metallic inclusions are characterized by that the ratio of length (l) to width (d) measured in the longitudinal cross-section of rolled steel is $l/d \leqq 5$. There is also disclosed a steel with a high degree of cleanliness in Japanese Patent Publication No. 74485/1994. This steel contains non-metallic inclusions whose average composition is $SiO_2$: 35~75%, MnO: $Al_2O_3$: ≦30%, CaO: 10~50%, and MgO: 3~25%. These non-metallic inclusions are characterized by that the ratio of length (l) to width (d) measured in the longitudinal cross-section of rolled steel is $l/d \leqq 5$.

The steels with a high degree of cleanliness disclosed in the above-mentioned patents are designed to improve the fatigue properties by controlling the average composition of non-metallic inclusions such that the ratio of length (l) to width (d) is $l/d \leqq 5$. The present inventors found that they have the following problems.

Even though the average composition of non-metallic inclusions is controlled so that $l/d \leqq 5$, there still exist hard inclusions exceeding this limit and they cause breakage. Moreover, even though inclusions are ductile and satisfy the condition $l/d \leqq 5$, they also cause breakage if they are thick.

OBJECT AND SUMMARY OF THE INVENTION

The present invention was completed in order to tackle the above-mentioned problems. It is an object of the present invention to provide a spring steel superior in fatigue properties.

The gist of the present invention resides in a spring steel superior in fatigue properties which is characterized in that oxide type inclusions therein have an average composition (by weight) specified as follows:

$35\% \leqq SiO_2 \leqq 75\%$ $5\% \leqq Al_2O_3 \leqq 30\%$ $10\% \leqq CaO \leqq 50\%$ $MgO \leqq 5\%$ (excluding 0%)

According to a preferred embodiment of the invention, the spring steel is characterized in that oxide type inclusions thinner than 5 μm account for more than 80% (in number) of total oxide type inclusions in the longitudinal cross-section of rolled steel.

Moreover, for improved fatigue properties, the spring steel should be produced such that its surface defects have a depth less than 1.0% of its diameter and its total decarburized depth is less than 1.0% of its diameter.

DESCRIPTION OF THE PREFERRED EMBODIMENT

Figure 1:
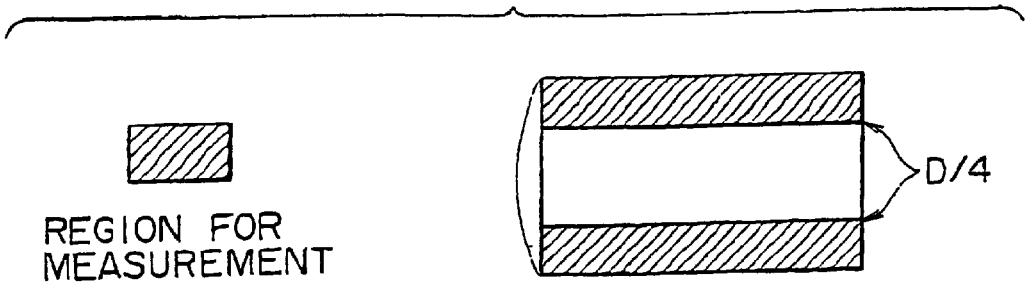
FIG. 1 is a schematic diagram showing the region in which to measure oxide type inclusions thinner than 5 μm.

The present inventors carried out extensive studies to provide a spring steel superior in fatigue properties. As the result, it was found that fatigue properties can be effectively improved by controlling the average composition of oxide type inclusions (simply referred to as inclusions hereinafter). It was also found that fatigue properties are greatly affected by the thickness of inclusions in the longitudinal cross-section of steel products.

As mentioned above, Japanese Patent Publication Nos. 74484/1994 and 74485/1994 disclose a steel with a high degree of cleanliness in which the average composition of non-metallic inclusions is controlled such that the ratio of length (l) to width (d) measured in the longitudinal cross-section of rolled steel is $l/d \leqq 5$. The present inventors found by contraries that the desired object is not achieved because breakage starts from inclusions if they are thick even though they are ductile and satisfy the condition l/d—5. In other words, it was found that the width of inclusions plays an important role in the improvement of fatigue properties and hence it is impossible to impart good fatigue properties by simply specifying the width of inclusions relative to the length of inclusions as in the above-mentioned patents. The present inventors carried out their investigation by noting the width of inclusions. As the result, they found that it is possible to obtain satisfactory fatigue properties if the number of inclusions thinner than 5 μm is controlled within a specific range. The present invention is based on this finding. The requirements of the present invention are explained in the following.

As mentioned above, in order for a spring steel to have improve fatigue properties, it is necessary that oxide type inclusions present therein have a melting point lower than 1500° C. According to the present invention to meet this requirement, oxide type inclusions should have an average composition (by weight) specified as follows:

$35\% \leqq SiO_2 \leqq 75\%$ $5\% \leqq Al_2O_3 \leqq 30\%$ $10\% \leqq CaO \leqq 50\%$ $MgO \leqq 5\%$ (excluding 0%)

This means that the ratio of components is controlled such that every inclusion has a melting point lower than 1500° C.

when the CaO concentration is plotted as the sum of the CaO concentration and MgO concentration in the phase diagram of $CaO—SiO_2—Al_2O_3$.

The term "average composition" means that the average composition of inclusions present in the steel product.

The spring steel according to the present invention is characterized in that oxide type inclusions therein have the average composition which is within the range specified above. As a matter of fact, it is very difficult to analyze all inclusions present in the steel. Therefore, it is assumed in the present invention that if more than 80% of inclusions has a melting point lower than 1400° C., then substantially all inclusions have a melting point lower than 1500° C. To be concrete, the spring steel according to the present invention should meet the condition that more than 80% of all oxide type inclusions has the composition (by weight) specified as follows.

$40\% \leqq SiO_2 \leqq 70\%$ $10\% \leqq Al_2O_3 \leqq 25\%$ $15\% \leqq CaO \leqq 45\%$ $MgO \leqq 3\%$ (excluding 0%)

In practice, if an examination of inclusions in sufficient number for composition indicates that inclusions having a melting point lower than 1400° C. account for more than 80%, it is assumed that all inclusions have a melting lower than 1500° C. The fact that inclusions have a melting point lower than 1400° C. is equivalent to the fact that said inclusions have the composition specified by $40\% \leqq SiO_2 \leqq 70\%$, $10\% \leqq Al_2O_3 \leqq 25\%$, $15\% \leqq CaO \leqq 45\%$, and $MgO \leqq 3\%$ (excluding 0%).

The spring steel whose inclusions have a controlled composition offers the advantage that all inclusions are made small and harmless during hot rolling or drawing. Therefore, springs formed from it are exempt from breakage that starts from inclusions.

One important factor in the present invention is to control the composition of inclusions as mentioned above. Another important factor is to control the thickness of inclusions. A portion of oxide type inclusions having the above-mentioned average composition should be thinner than 5 $\mu$m. Such a portion should account for more than 80% (in number) of all oxide type inclusions in the longitudinal cross-section of the rolled steel product. The term "thickness" used in this specification has the same meaning as "width" used in the prior art technology. These inclusions assume the shape which is elongated in the direction of rolling. The size of each inclusion measured in the direction approximately perpendicular to the lengthwise direction is defined as thickness. To be concrete, the thickness is calculated in the following way. Cut lengthwise the wire rod in question. Select in the longitudinal cross-section two regions (hatched parts in FIG. 1) each having a width equal to D/4 (where D is the diameter of the wire rod) measured from the lengthwise edge. Count the number of all oxide type inclusions present in 1000 $mm^2$ of the regions. Also, count the number of oxide type inclusions having the above-mentioned average composition and the thickness smaller than 5 $\mu$m. Calculate the ratio of the second count to the first count. The specimen should be observed under a microscope and more than 10 samples should be taken at random in the specified area (1000 $mm^2$) and their observed values should be averaged. As mentioned above, the thickness of inclusions in the longitudinal cross-section of a steel product greatly affects the improvement of fatigue properties. For this reason, the present invention specifies the thickness of inclusions so as to improve the fatigue properties.

For improved fatigue properties, the present invention requires that the spring steel should be produced such that its surface defects have a depth less than 1.0% of its diameter and/or its total decarburized depth is less than 1.0% of its diameter.

The term "depth of surface defects" means the maximum value of the depths of the surface defects present. The term "total decarburized depth" means the maximum value of the depths of the total decarburized layer.

The depth of surface defects is measured by observing the cross-section of the end of the wire rod under a microscope. It is known that the depth of surface defects also has an adverse effect on fatigue properties. For this reason, the present invention specifies that the depth of surface defects should be less than 1.0% of the diameter of the wire rod.

The total decarburized depth is measured according to the method provided in JIS G558 "Total decarburized depth" (microstructure). It is also known that the total decarburized depth adversely affects the fatigue properties. For this reason, the present invention specifies that the total decarburized depth should be less than 1.0% of the diameter of the wire rod.

According to the present invention, the depth of surface defects and the total decarburized depth are controlled as mentioned above so as to prevent springs from braking due to these defects.

The spring steel of the present invention is not specifically restricted in steel composition so long as it meets the above-mentioned requirements. It may have any steel composition for ordinary spring steels. A typical example of the composition is as follows: C: 0.38~0.85%, Si: 0.25~2.10%, Mn: 0.2~1.0%, $P \leqq 0.035\%$, $S \leqq 0.035\%$, with the remainder being iron and inevitable impurities. It may optionally contain less than 2.5% (in total) of at least one member selected from the group consisting of Cr (0.65~1.5%), Mo (0.1~0.5%), V (0.05~0.30%), Ni (0.2~0.5%), Nb (0.02~0.06%), Ti (0.02~0.09%), and Cu (0.10~0.30%).

EXAMPLE

The invention will be described in more detail with reference to the following example, which is not intended to restrict the scope thereof. Various changes and modifications may be made in it without departing from the scope and spirit of the invention.

Example 1

A valve spring steel was produced by using a 90-ton converter. In the refining process for adjustment of composition, it was incorporated with Ca and Al alloys in various amounts so that oxide type inclusions have the composition as follows.

$40\% \leqq SiO_2 \leqq 70\%$, $10\% \leqq Al_2O_3 \leqq 25\%$, $15\% \leqq CaO \leqq 45\%$, $MgO \leqq 3\%$.

The resulting samples were examined for relation between the composition of inclusions and the fatigue life. The composition of the steel sample is shown in FIG. 1. The fatigue life was measured as follows. The steel sample was rolled into a wire rod (8.0 mm in diameter), which was then drawn into a wire (4.6 mm in diameter) with oil tempering. The wire sample underwent rotary bending fatigue test (Nakamura type). The number of repetitions required for the sample to break was recorded. Incidentally, the oil tempered wire has a strength of 2100 MPa and the test stress is 850 MPa.

TABLE 1

| C | Si | Mn | P | S |
|---|---|---|---|---|
| 0.51~0.59 | 1.35~1.60 | 0.60~0.80 | ≦0.020 | ≦0.015 |
| Cu | Ni | Cr | Al | Ti |
| ≦0.06 | ≦0.10 | 0.60~0.80 | ≦0.003 | ≦0.003 |

Figure 2:
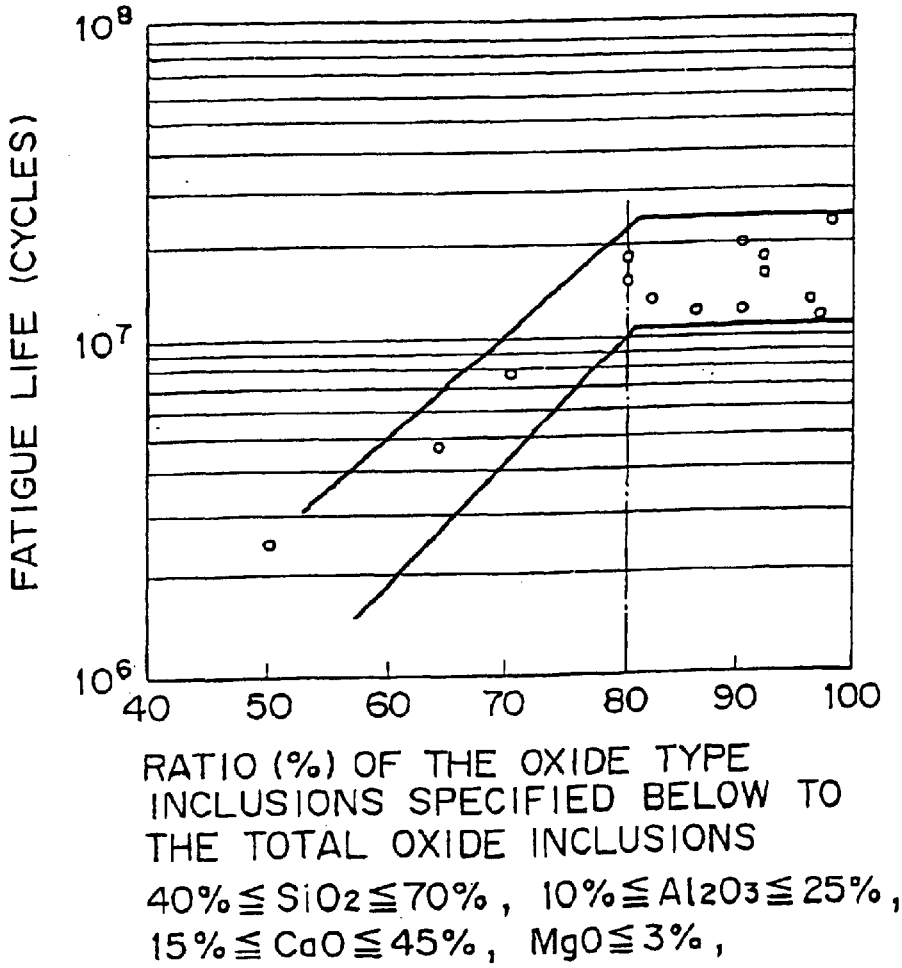
FIG. 2 is a graph showing how the fatigue life varies depending on the ratio of the specified inclusions to the total oxide type inclusions.

FIG. 2 is a graph showing how the fatigue life varies depending on the ratio of the specified inclusions to the total oxide type inclusions. It is noted from FIG. 2 that the samples have the intended fatigue life ($10^7$ cycles) if the ratio is higher than 80%, whereas the samples have a fatigue life much shorter than intended if the ratio is lower than 80%.

Figure 3:
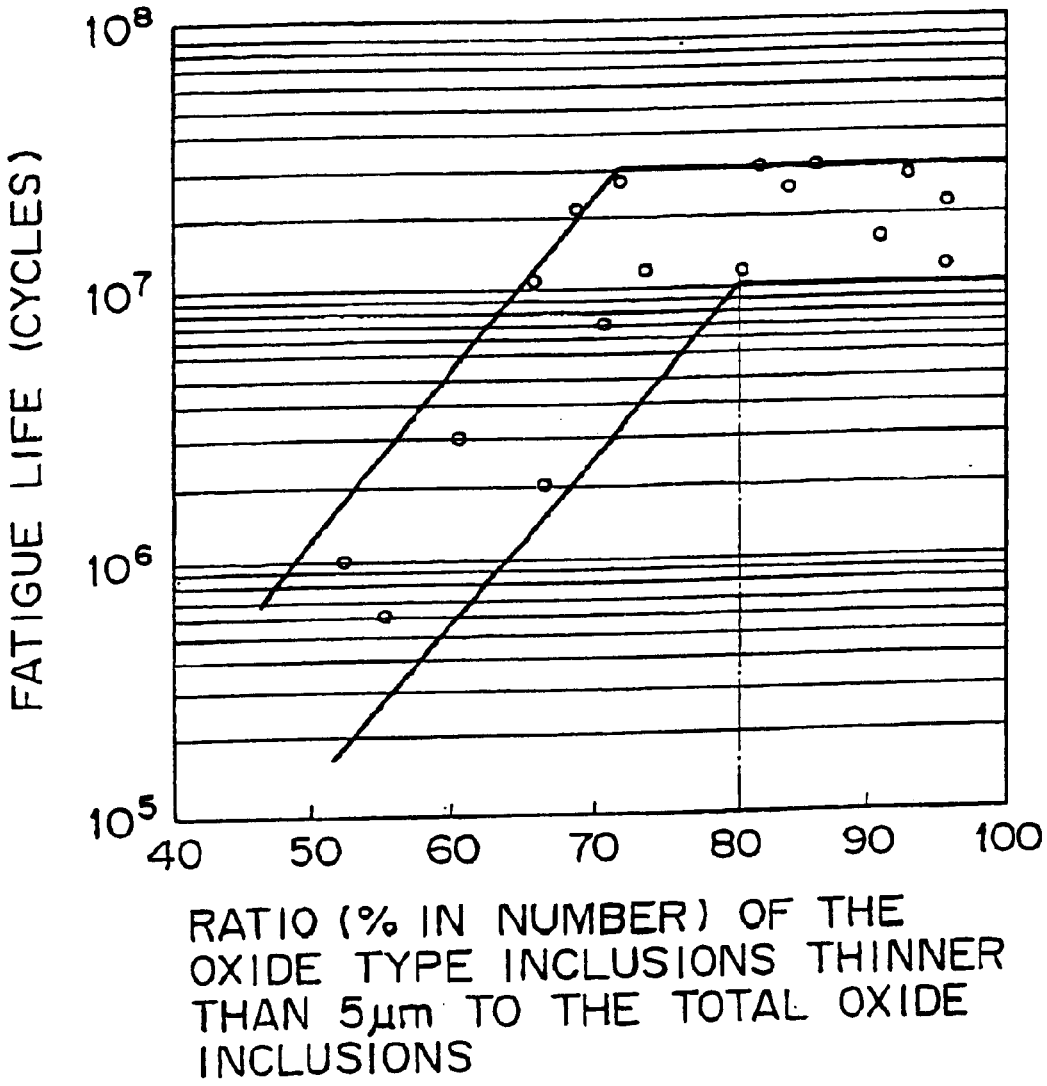
FIG. 3 is a graph showing how the fatigue life varies depending on the ratio (in number) of the specified inclusions thinner than 5 μm to the total oxide type inclusions.

FIG. 3 is a graph showing how the fatigue life varies depending on the ratio of inclusions thinner than 5 $\mu$m in the total oxide type inclusions. It is noted from FIG. 3 that the samples always have the intended fatigue life ($10^7$ cycles) if the ratio is higher than 80%.

The ratio of inclusions thinner than 5 $\mu$m will be higher than 80% if the steel is produced such that inclusions have the above-specified composition and rolled at an adequate temperature with a sufficient reduction ratio. The reduction ratio is defined as the ratio of the sectional area of the ingot to the sectional area of the product. To be specific, the reduction ratio should be greater than 100 and the rolling temperature should be higher than 750° C.

Samples of wire rods were produced in which inclusions thinner than 5 $\mu$m account for 80% (in number) of the total oxide type inclusions. They were tested to see how they vary in fatigue properties depending on the ratio of the depth of surface defects to their diameter. They were also tested to see how they vary in fatigue properties depending on the ratio of the total decarburized depth to their diameter. The results are shown in FIGS. 4 and 5.

Surface defects which occur due to pressed scale during heating vary in their depth according to the heating temperature and time. Also, the total decarburized depth varies depending on the heating temperature, atmosphere, and time.

Figure 4:
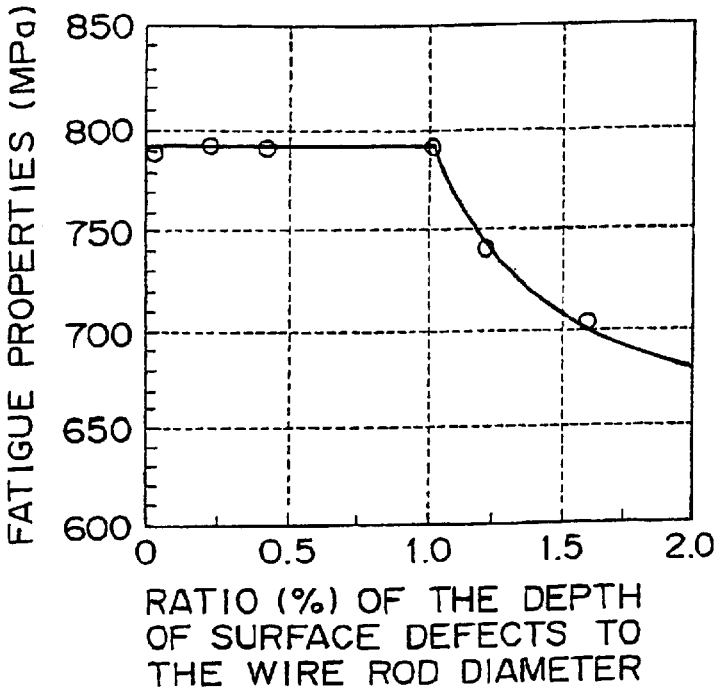
FIG. 4 is a graph showing how the fatigue properties varies depending on the ratio of the depth of surface defects to the wire rod diameter.

FIG. 4 is a graph showing how the fatigue properties varies depending on the ratio of the depth of surface defects to the wire diameter. It is noted from FIG. 4 that the fatigue properties decrease in inverse proportion to the depth of surface defects if the ratio of the depth of surface defects to the wire diameter exceeds 1.0%. This suggests that breakage starts from the surface defects. By contrast, stable, almost constant fatigue properties are obtained regardless of the depth of surface defects if the ratio of the depth of surface defects to the wire diameter is kept less than 1.0%.

Figure 5:
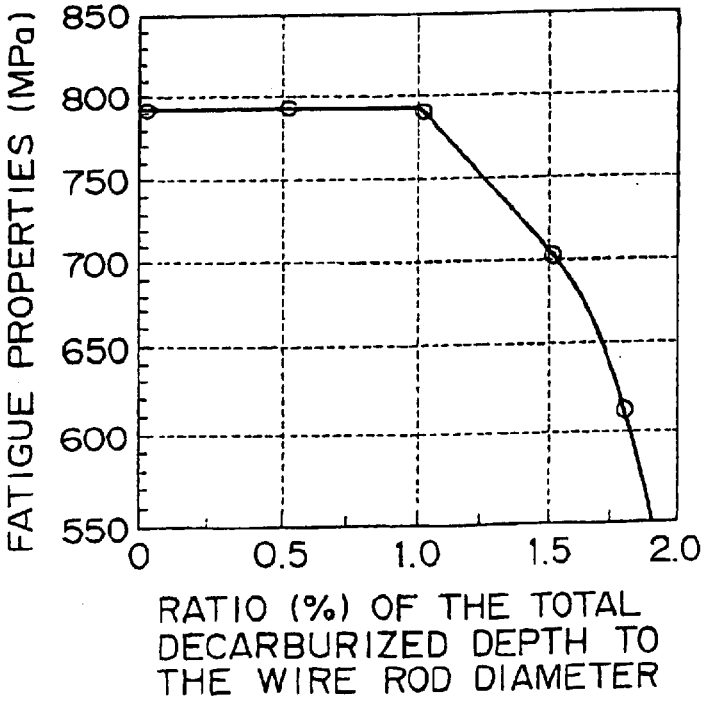
FIG. 5 is a graph showing how the fatigue properties varies depending on the ratio of the total decarburized depth to the wire rod diameter.

FIG. 5 is a graph showing how the fatigue properties varies depending on the ratio of the total decarburized depth to the wire diameter. It is noted from FIG. 5 that the fatigue properties decrease in inverse proportion to the total decarburized depth if the ratio of the total decarburized depth to the wire diameter exceeds 1.0%. This suggests that breakage starts from the total decarburized layer. By contrast, stable, almost constant fatigue properties are obtained regardless of the total decarburized depth if the ratio of the total decarburized depth to the wire diameter is kept less than 1.0%.

Effect of the Invention

The present invention constructed as mentioned above provides a spring steel superior in fatigue properties.

What is claimed is:

1. A spring steel comprising, by weight, 0.38–0.85% C;

0.25–2.10% Si;

0.2–1.0% Mn;

not more than 0.035% P; and not more than 0.035% S, wherein oxide inclusions in the spring steel have an average composition, by weight, specified as follows:

$35\% \leqq SiO_2 \leqq 75\%$;

$5 \leqq Al_2O_3 \leqq 30\%$;

$10\% \leqq CaO \leqq 50\%$; and $MgO \leqq 5\%$, excluding 0%; and wherein the ratio of the depth of surface defects to the diameter of the spring steel is less than 1.0%.

2. The spring steel as defined in claim 1, wherein oxide inclusions thinner than 5 $\mu$m account for more than 80% of the total number of oxide inclusions in a longitudinal cross-section of a rolled steel.

3. The spring steel according to claim 1, further comprising by weight, 0.65–1.5% Cr.

4. The spring steel according to claim 1, further comprising, by weight, 0.2–0.5% Ni.

5. A method of making a spring steel, the method comprising forming oxide inclusions in a steel sample; and producing the spring steel of claim 1.

6. The method according to claim 1, wherein the forming comprises adding Ca and Al alloys to the steel sample.

7. A spring steel comprising, by weight, 0.38–0.85% C;

0.25–2.10% Si;

0.2–1.0% Mn;

not more than 0.035% P; and not more than 0.035% S, wherein oxide inclusions in the spring steel have an average composition, by weight, specified as follows:

$35\% \leqq SiO_2 \leqq 75\%$;

$5 \leqq Al_2O_3 \leqq 30\%$;

$10\% \leqq CaO \leqq 50\%$; and $MgO \leqq 5\%$, excluding 0%; and wherein the ratio of the total decarburized depth to the diameter of the spring steel is less than 1.0%.

8. A method of making a spring steel, the method comprising forming oxide inclusions in a steel sample; and producing the spring steel of claim 7.

9. The method according to claim 8, wherein the forming comprises adding Ca and Al alloys to the steel sample.

* * * * *